US005438713A

United States Patent [19]

Clarke

[11] Patent Number: 5,438,713

[45] Date of Patent: Aug. 8, 1995

[54] SEAMLESS BATHROOM MODULE FOR A MARINE VESSEL

[75] Inventor: Richard E. Clarke, Auburn, Wash.

[73] Assignee: Amtech Corporation, Yelm, Wash.

[21] Appl. No.: 188,494

[22] Filed: Jan. 28, 1994

[51] Int. Cl.[6] ..... A47K 8/00; E03C 1/20; E03C 1/29

[52] U.S. Cl. ..... 4/663; 4/679; 4/640

[58] Field of Search ..... 4/662, 663, 664, 679, 4/680, 681, 640, 642, 650, 653; 52/34, 35, 79.1, 220.1, 302.1

[56] References Cited

U.S. PATENT DOCUMENTS

| | | | |
|---|---|---|---|
| 1,751,877 | 3/1930 | Nance | 4/679 |
| 1,978,842 | 10/1934 | Hooton | 189/1 |
| 2,419,319 | 4/1947 | Lankton | 20/2 |
| 2,712,863 | 7/1955 | Busch | 189/2 |
| 3,015,110 | 1/1962 | Treand | 52/79.1 |
| 3,047,106 | 7/1962 | Callahan | 189/1 |
| 3,110,907 | 11/1963 | King | 4/2 |
| 3,590,392 | 7/1971 | Hollander et al. | 4/663 |
| 3,590,393 | 7/1971 | Hollander et al. | 4/2 |
| 3,821,818 | 7/1974 | Alosi | 4/191 |
| 3,978,529 | 9/1976 | Krafft | 4/2 |
| 4,142,255 | 3/1979 | Togni | 4/1 |
| 4,221,441 | 9/1980 | Bain | 312/228 |
| 4,622,911 | 11/1986 | Salminen | 4/663 |
| 4,722,154 | 2/1988 | Virta et al. | 52/79.1 |
| 4,745,712 | 5/1988 | O'Leary | 52/34 |
| 4,788,802 | 12/1988 | Wokas | 52/79.1 |

OTHER PUBLICATIONS

"LAVTEC TM Handicapped-Accessible Unit," AMTECH Corporation Brochure, pp. 1–2.

"LAVTEC TM The Seamless Solution," AMTECH Corporation Brochure, pp. 1–4.

"LAVTEC TM 5ft×8ft Hotel/Residential Unit," AMTECH Corporation Brochure, pp. 1–2.

"Modular Marine Bathrooms," Frenkin Corporation Brochure, pp. 1–4, 1984.

*Primary Examiner*—Robert M. Fetsuga
*Assistant Examiner*—Charles R. Eloshway
*Attorney, Agent, or Firm*—Seed and Berry

[57] ABSTRACT

A prefabricated bathroom module for installation onto a deck of a marine vessel. The module having a floor sloped toward a drain assembly, a plurality of walls extending upward from the floor, and a ceiling attached to the top of the walls. The drain assembly has a drain trap arrangement with a drain line that extend from between the module floor and the deck of the vessel and connect to a drainage system of the vessel without penetrating through the deck. The module further having a plumbing system with water supply lines connected to the outside of the walls and routed to a common area, with control valves connected to the drain lines at the common area. An access panel mounted to a wall of the module adjacent to the control panels to provide a user easy access to the control valves. The plumbing system further including drain lines attached to the outside of the module and routing to the common area where the plumbing system of the module attaches to the drainage system of the vessel.

16 Claims, 5 Drawing Sheets

SEAMLESS BATHROOM MODULE FOR A MARINE VESSEL

TECHNICAL FIELD

The present invention relates to prefabricated modular rooms, and more particularly to prefabricated bathroom modules for marine vessels.

BACKGROUND OF THE INVENTION

Large ships having several levels or decks are constructed with complex and self-contained water, supply, drainage, and waste systems that extend throughout the ship. Lavatories, vanities, washrooms, water closets, and the like, hereinafter collectively referred to as bathrooms, are operably attached to one or more of these plumbing systems. Prefabricated bathroom modules with bathroom fixtures therein and integral, conventional plumbing systems have been installed in ships during initial construction or subsequent retrofit projects. These prefabricated bathroom modules have provided a cost effective method of installing bathrooms in the ships.

During installation the plumbing system of the bathroom module is connected directly to the plumbing system of the ship. The conventional plumbing system of the bathroom module includes water supply lines that connect to bathroom fixtures, such as sinks, bathtubs, showers, and toilets, and drain lines that connect to the drains in the bathroom fixtures and to conventional floor drain assemblies.

Typically a building specification for construction of a ship includes several strict requirements for the plumbing system of a bathroom module. For example, a drain trap must be provided between the floor drain and the drain system of the ship. In addition, the bathroom drain lines must have a minimum slope to provide sufficient drain capabilities during operation of the ship.

Although the conventional plumbing systems of the bathroom modules have been able to meet the strict specification requirements, the plumbing systems have created several problems and resulted in several difficulties that reduce the economical benefit of the bathroom modules. A typical drain trap for a floor drain has a length of pipe that extends downward from the floor of the bathroom module and connects to an elbow fitting which acts as the trap. This drain trap arrangement requires a large space between the floor of the bathroom module and the deck to properly accommodate the elbow fitting and to allow for installation of the module. As such, the floor of the bathroom module must be elevated a substantial distance above the deck, thereby creating a high step into or out of the module. This high step creates a very inconvenient bathroom arrangement in, for example, ship state rooms.

The conventional drain trap arrangement also requires that a drain pipe pierce through the deck of the ship before attaching to the ship drain system. When several floor drains are included in a bathroom module, the deck must be pierced several times. As a result, installation of the bathroom module is very time-consuming and labor-intensive, because a hole must be cut in the deck for each drain line, and each hole must be sealed after the drain line is installed. This laborious installation process reduces the economical benefit of using the bathroom modules.

Substantial problems are also experienced because of leakage through the deck around the drain lines. Because the drain system of the ship also passes through the deck, it is highly desirable to minimize the number of holes in the deck by attaching the bathroom drain lines to the ship drain system above the deck while maintaining the required drain characteristics.

The water supply system of a conventional bathroom module also has created problems and difficulties during installation and maintenance of the bathroom module. For example, hot and cold water supply lines, each of which may branch to various bathroom fixtures must have a shutoff valve accessible by a person within the module. Typically, the water supply lines extend through the module wall and the control valves are located within the module. Thus, the water supply lines and control valves are hidden by fixtures, such as cabinets, or separated and placed in awkward areas that are difficult to access. This arrangement of the control valves makes installation and maintenance of the bathroom module more time consuming, costly, and inconvenient.

SUMMARY OF THE INVENTION

The present invention provides a unique and complete bathroom module for a marine vessel with the module having improved water supply and drain systems as well as improved accessibility to control valves for the water supply system. In a preferred embodiment of the invention, the bathroom module sits on the deck of the vessel with a module floor being supported a short distance above the deck by a plurality of supports. The floor is slanted at a known angle relative to the deck toward a drain assembly attached to the floor. A plurality of interconnected walls are connected at their bottom edges to the floor and attached at their top edges to a ceiling, thereby forming an interior area of the bathroom. Bathroom fixtures are mounted therein to provide desired bathroom features.

A drain assembly is attached to the floor, and is positioned between the floor and the deck. The drain assembly has a sloped drain line that extends out from between the floor and the deck and attaches to the drain system of the ship without passing through the deck. A plumbing system having water supply lines and drain lines that connect to at least one of the bathroom fixtures is mounted to the outside of the module walls, and routes to a common area adjacent to an access panel mounted in a wall. Control valves on the water supply lines are located at this common area and are adjacent to the access panel.

The drain assembly has at least one drain pipe, a drain trap bowl that is attached to the floor between the floor and the deck. The sloped drain line is attached at one end to the drain trap bowl and attached at an opposite end to the ship's drain system. The drain bowl provides a trap while the fluid passed out of the drain trap bowl through an aperture, which is connected to the sloped drain line, formed in the side of the bowl-shaped component. In an alternate embodiment, the floor drain assembly is a double drain assembly that accommodates two adjacent drains in the floor of the module.

DETAILED DESCRIPTION OF THE INVENTION

Figure 1:
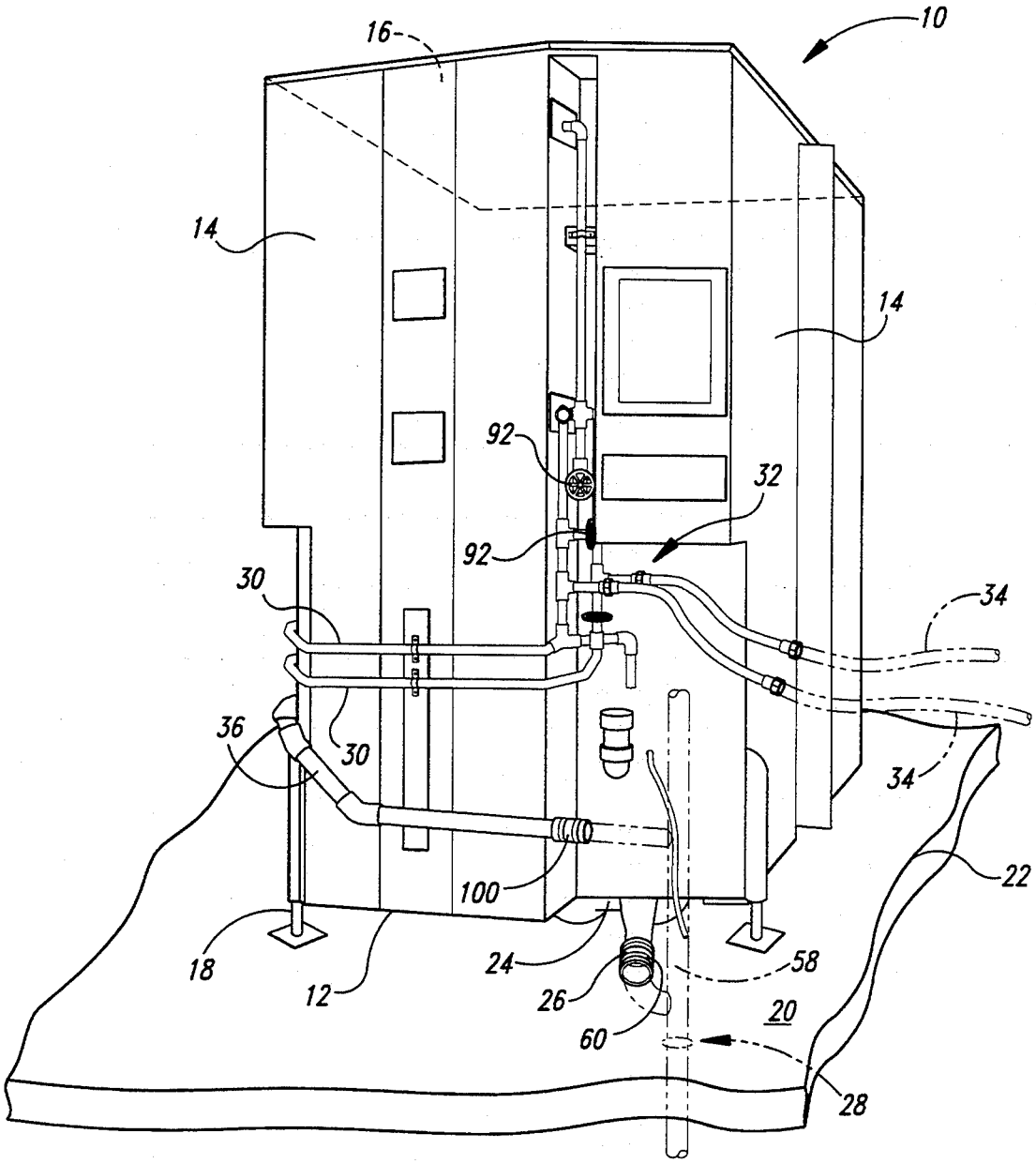
FIG. 1 is a perspective isometric view of a bathroom module in accordance with the present invention, with the module located on a partially cutaway deck of a marine vessel, and with plumbing system attached to a partially cutaway plumbing system of the marine vessel, shown in phantom.

As best seen in FIG. 1, a bathroom module 10 in accordance with the present invention is a modular room formed by a floor 12, a plurality of walls 14 connected to the floor, and a ceiling 16 attached to the top of the walls. Supports 18 attached to the bottom of the module 10 extend downward and sit on a deck 20 of a ship 22 or other marine vessel, so the floor 12 is positioned above the deck with a space therebetween.

A drain assembly 24 is attached to the floor 12 and extends downward into the space between the floor 12 and the deck 20. A drain line 26 of the drain assembly 24 extends out from under the floor 12 and attaches to a ship drainage system 28 shown in phantom without penetrating through the deck 20. As such, the drain assembly 24 allows water or other fluids to be passed from within the module 10 out to the ship's drainage system.

Water is supplied to the module 10 through water supply lines 30 of a module plumbing system 32 mounted to the outside of the walls 14. The water supply lines 30, which connect to a water supply lines 34 of the ship, shown in phantom, route to a common area of the module where control valves 92 are positioned adjacent to an access panel. The plumbing system 32 also has one or more drain lines 36 earned by the walls 14 that attach at one end to a bathroom fixture (not shown) in the module 10, and attach at the opposite end to the ship's drain system 28.

Figure 2:
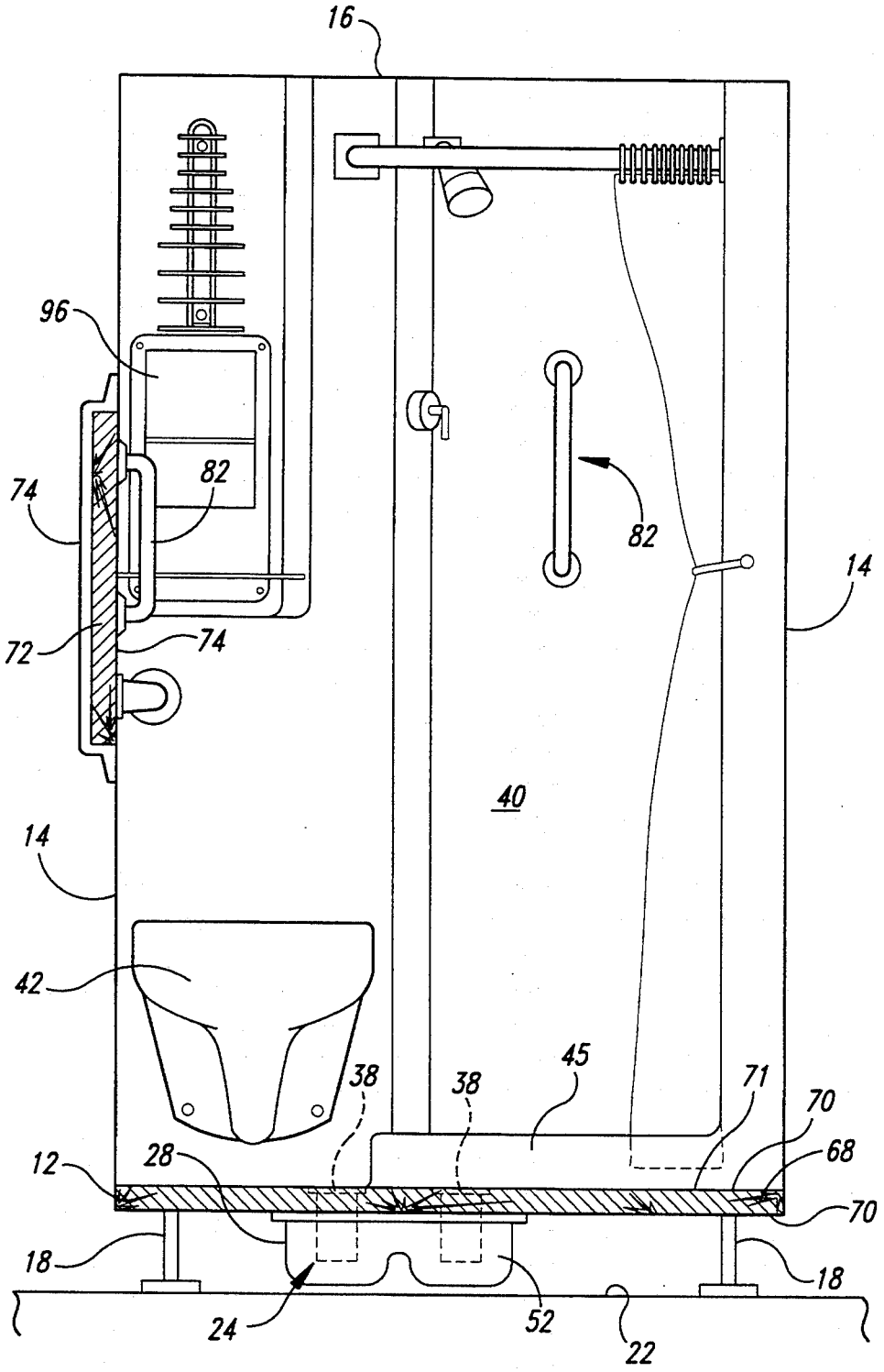
FIG. 2 is an enlarged schematic side elevation view of the bathroom module of FIG. 1 with a wall removed showing the interior of the module.

As best seen in FIGS. 1 and 2, the drain assembly 24 attaches to the floor 12, extends downward, and terminates just above the deck 20. In the preferred embodiment, the distance between the drain assembly 24 and the deck 20 can be adjusted, because the supports 18 are adjustable, leveling supports that can be lengthened or shortened to raise or lower the floor 12 relative to the deck. The preferred drain assembly 24 has a low profile and it extends below the floor approximately four and one-half inches, so the top of the floor is approximately six inches above the deck 20. Accordingly, a person using the bathroom module 10 has to step up only a short distance to enter the module.

The drain assembly 24 provides two adjacent drains 38, shown in FIGS. 2 and 3, in the floor 12 of the module; one in a shower 40 and one outside of the shower below a toilet 42. The floor 12 slopes toward the two drains 38, so any water on the floor, either inside or outside of the shower 40, will run into one of the drains and be carried from the module to the drainage system 28 of the ship. Although the drain assembly 24 of the preferred embodiment provides two adjacent drains 38, the assembly can be configured to provide only one drain or more than two drains.

Figure 4:
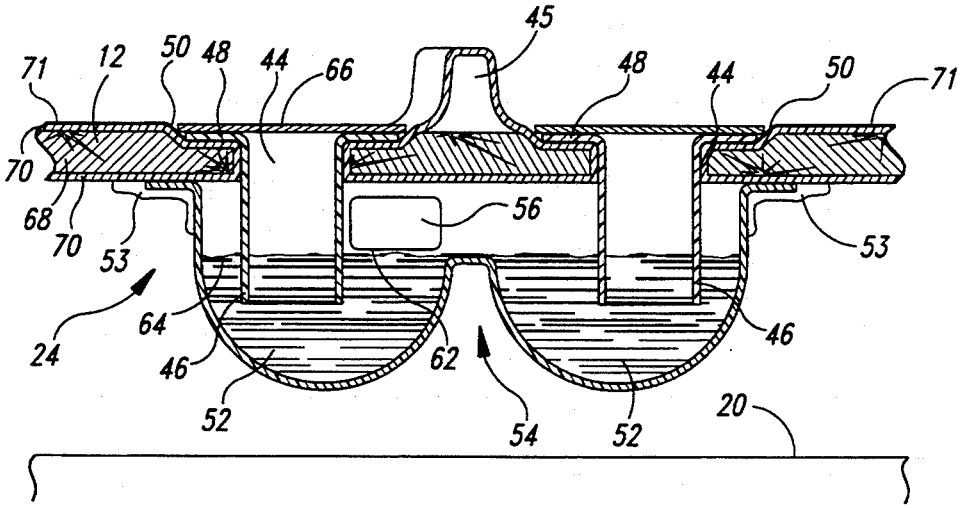
FIG. 4 is an enlarged cross-sectional view of the drain assembly taken substantially along line 4—4 of FIG. 3.

As best seen in FIG. 4, the drain assembly 24 communicates with two adjacent drain holes 44 that extend through the floor 12. The two drain holes 44 are separated by a shower dam 45 that extends upward from the top of the floor 12 and provides a barrier that blocks water on the floor of the shower 40 from flowing onto the remainder of the floor.

In the preferred embodiment, the drain assembly 24 has a double drain configuration to accommodate both drain holes 44. However, the drain assembly 24 can be configured for a single drain hole. The portion of the drain assembly 24 that communicates with one of the drain holes 44 has a construction that is substantially the same as the portion of the drain assembly communicating with the second drain hole. As such, only one side of the drain assembly 24 will be described below in detail, with the description being applicable to both sides.

A drain pipe 46 having a diameter slightly smaller than the drain hole 44 fits into and extends through the drain hole toward the deck 20. The drain pipe 46 has a top flange 48 that engages the top of the floor 12 and prevents the drain pipe from falling through the drain hole 44. The top of the floor 12 has a recessed annular area 50 around the drain hole 44 that receives the flanges, so the top of the drain pipe is slightly below the top of the floor.

The drain pipe 46 channels water from the floor 12 into a drain trap bowl 52 that is mounted to the bottom surface of the floor. The drain pipe 46 extends partially into the drain trap bowl 52. Each of the drain trap bowls 52 extends downward from the floor toward the deck and is secured to the floor around the drain hole 44 and the drain pipe 46. A bowl-like shape of each drain trap bowl 52 acts to retain fluids therein that pass through the drain pipe 46. The drain trap bowl 52 is secured to the floor 12 by adhering a flange portion 53 that is around the top of the bowl structure to the bottom surface of the floor. In the preferred embodiment, the two drain trap bowls 52 are integrally connected to form a double bowl structure 54, as discussed below, and the flange portions 53 of the drain trap bowls are sealed against the floor 12 so the drain assembly will not leak under the floor if water inadvertently fills the bowl structures.

The drain trap bowl 52 has an aperture 56 formed in its side that allows fluid to flow out of the drain trap bowl and into the drain line 26 that attaches to the drain trap bowl around the aperture. As best seen in FIGS. 1 and 3, the drain line 26 extends outward from the drain trap bowl 52 through the space between the deck 20 and the floor 12 of the module 10 and connects to a flexible drain tree 58 of the ship drainage system 28. The drain line 26 slopes downward as it extends toward the drain tree 58 so fluid will properly move through the drain line into the drain system.

Figure 5:
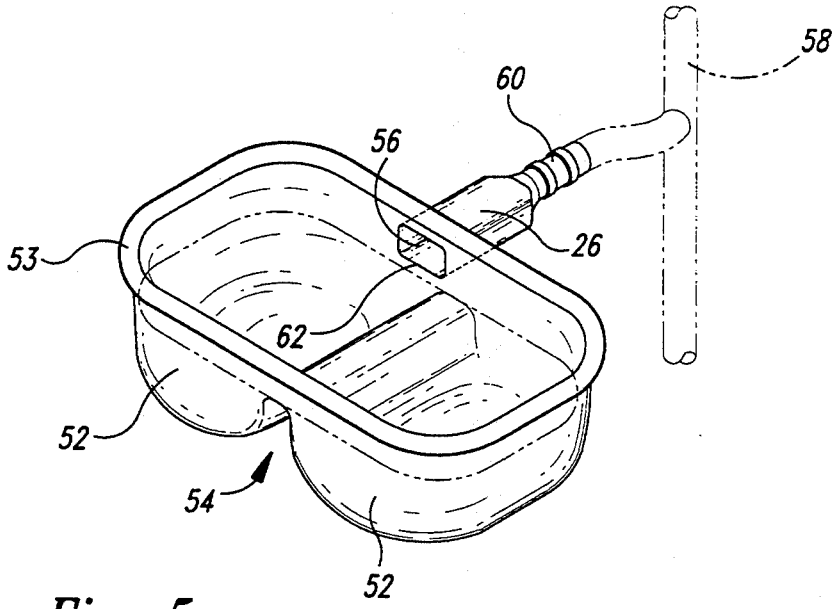
FIG. 5 is an enlarged isometric view of drain trap bowls of the drain assembly of FIG. 1 removed from the bathroom module.

Referring to FIG. 5, the drain line 26 is integrally connected to the side of the drain trap bowl 52, and the drain line has a downward slant of approximately ¼" to ½" vertical drop along its length. The drain line 26 has a square cross-sectional shape at its intersection with the drain trap bowl 52, and the drain line changes to a circular cross-sectional shape at the opposite end. A flexible connection fitting 60 is provided at the opposite end of the drain line 26 to attach the drain line to the drain tree 58, shown in phantom. The square aperture 56 and the cross-sectional shape of the drain line allows for better drainage from the drain trap bowl 52, while the circular cross-sectional shape is compatible with standard for drain system connections.

Returning to FIG. 4, the square aperture 56 and the drain trap bowl 52 allows water or other fluid passed into the drain trap bowl to flow therefrom until the fluid level within the drain trap bowl reaches the lower edge 62 of the aperture. Accordingly, the bottom edge 62 of the aperture 56 corresponds to a predetermined water level 64 within the drain trap bowl 52, so a known amount of water will remain in the bowl before any water drains to the ship drainage system.

As indicated above, the drain pipe 46 extends downward into the drain trap bowl 52 and terminates approximately two inches below the water level 64, although the length of the drain pipe can be varied as required by ship building specifications. This arrangement allows the water passing through the drain pipe 46 to force the water in the drain trap bowl 52 up and out of the aperture 56. The configuration of the drain pipe 46 extending into the water also minimizes malodorous emanations that can be generated in drains.

The top of the drain pipe 46 is covered with a grill 66 or other screen-like device that prevents solid materials over a predetermined size from passing though the drain pipe. The grill 66 is removably mounted to the top of the drain pipe 46 and is shaped to sit within the recessed annular area 50 in the floor 12 around the drain hole 44 and be flush or slightly below the top surface of the floor. The removable grill 66 allows for easy cleaning of the drain pipe 46 and a portion of the drain trap bowl 52. The drain pipe 46 can also be removed for cleaning purposes and to allow access to the entire drain trap bowl 52.

Accordingly, the drain trap bowl 52 provides a drain trap below the floor drain that will retain heavy or solid items in the bottom of the bowl-like structure while the fluid passing into the drain trap bowl will flow out of the drain assembly 24 and into the ship drainage system 28.

Figure 3:
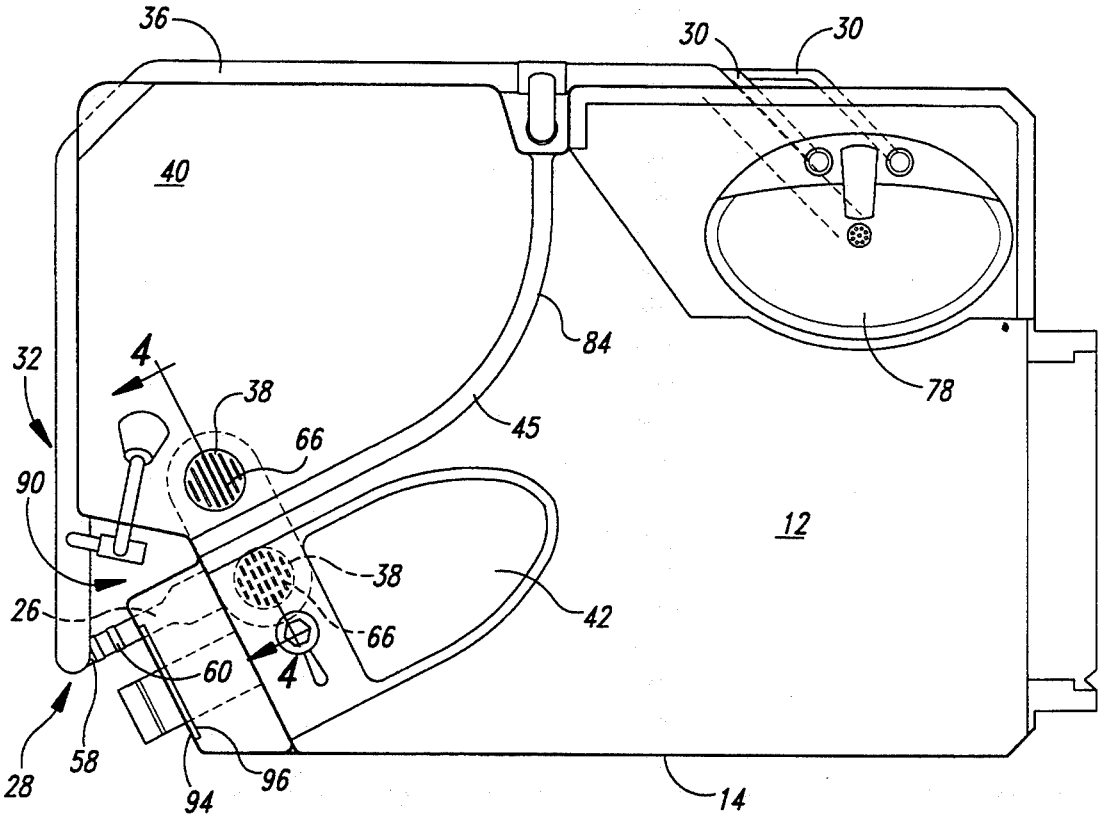
FIG. 3 is an enlarged schematic plan view of the bathroom module of FIG. 1 with the ceiling removed and with a drain assembly shown in phantom.

As seen in FIGS. 3, 4, and 5, the drain assembly 24 is a double drain assembly having two adjacent drain trap bowls 58 that are attached to each other at a level corresponding to the desired water line 64. The drain trap bowls 52 are preferably integrally connected at the water line 64 so water will not leak through the bowl connection and so can pass between the drain trap bowls if one of the drains, such as the drain in the shower, experience a high flow of water. The double drain assembly only requires a single aperture 56 that will allow fluid to flow from the drain trap bowls. Alternatively, a double drain arrangement can have two apertures that attach to one or two drain lines. Other embodiments of the drain assembly can have only one drain pipe and one drain trap bowl with one aperture therein with a drain line connecting to the aperture.

In the preferred embodiment, these drain trap bowls 52 are molded fiberglass components that are permanently secured to the bottom surface of the floor 12 by fiberglassing the flange 53 to the floor. Thus, the drain assembly 24 forms integral drain traps of the module.

As a result of the low profile drain assembly 24, the floor 12 of the bathroom module 10 is substantially closer to the deck 20 and the drain assembly does not penetrate through the deck of the vessel, so problems with respect to sealing or leakage through such penetrations are avoided.

As best seen in FIG. 2, the floor 12 to which the drain assembly 24 attaches is a laminated structure having a plywood core 68 with a fiberglass layer 70 or other suitable material attached to the top and bottom of the plywood core, and a top gel coat layer 71 on the fiberglass to provide a smooth surface. A floor covering, such as tile or the like can be attached to the top gel coat layer 70 to provide a finished bathroom floor surface. The floor 12 is integrally connected to the bottom of the walls 14. The walls 14 of the preferred embodiment are interconnected, seamless fiberglass structures that have integral support plates 72 sandwiched between fiberglass layers 74. Thus the floor 12 and walls 14 form a seamless, molded fiberglass structure.

The support plates 72 are ¾" plywood to provide a mounting area for attaching wall-hung bathroom fixtures, such as the toilet 42, grab bars 82, and the like, to the walls. The fiberglass walls are connected to the ceiling 16, which is also a fiberglass structure with support plates therein. Thus, the walls and ceiling form a fiberglass shell secured to the laminated floor 12. The supports 18 are attached to the bottom of the walls 14 and located at the corners of the module 10.

The bathroom formed by the walls 14, floor 12, and ceiling 16, has a plurality of bathroom fixtures, such as the shower 40, a sink assembly 78, a toilet 42, curtain rod 84, and the like, mounted therein, as shown in FIG. 2.

Figure 6:
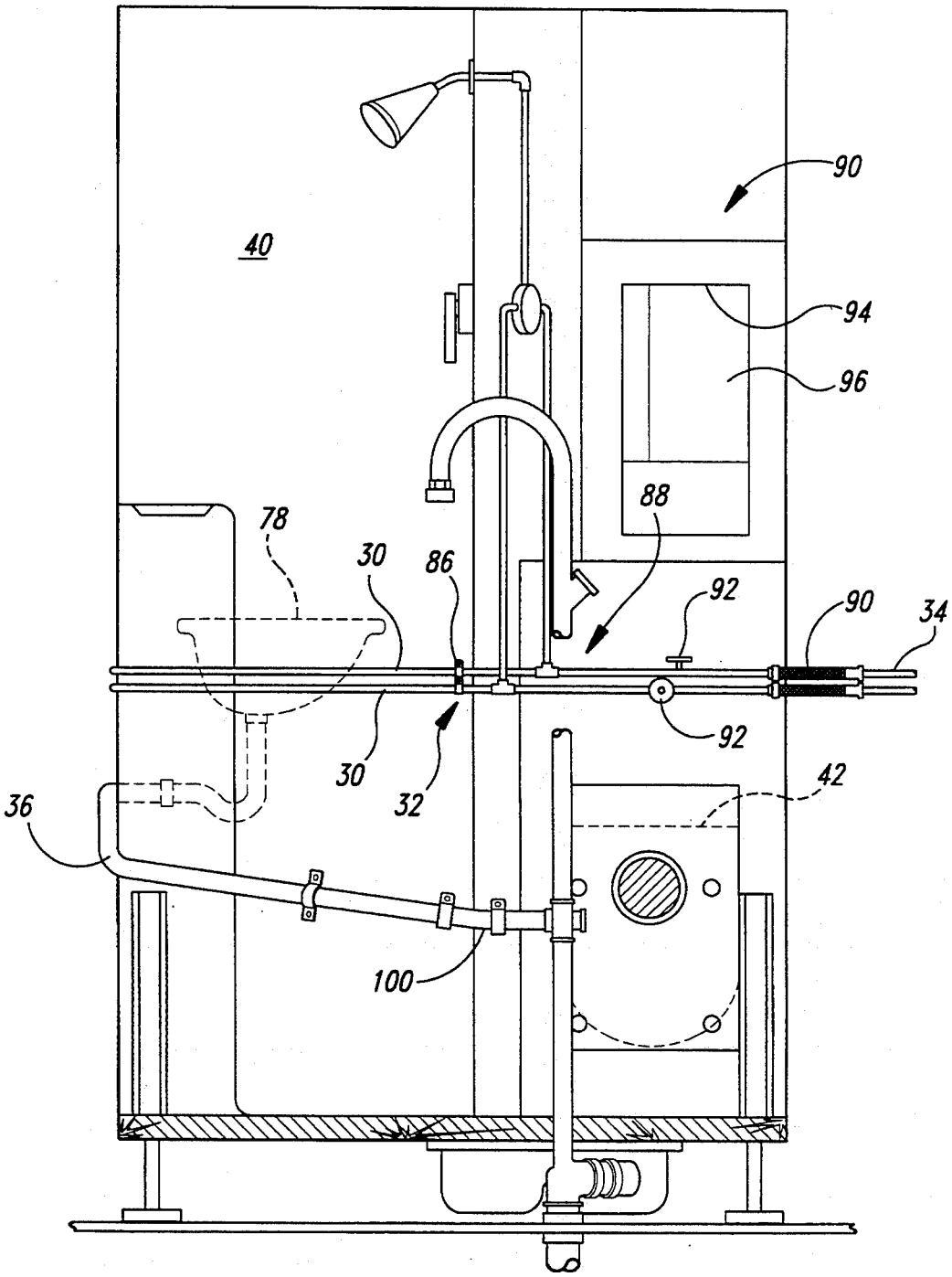
FIG. 6 is an enlarged side elevation view of the bathroom module of FIG. 1, with water supply lines of the module attached to water supply lines of the vessel and drain lines attached to a drain tree of the vessel plumbing system.

As indicated above, the module 10 a plumbing system 32 that is operational upon being connected to the plumbing system of the ship. As best seen in FIGS. 3 and 6, the module plumbing system 32 includes the water supply lines 30 that attach to the outside of the walls 14 with conventional brackets 86. The water supply lines 30 connect to at least one of the bathroom fixtures and route around the module 10 to a common outer area 88 of the module. The common area 88 is located in a recessed portion 90 formed at the intersection of two of the walls 14. In the preferred embodiment, the common area 88 is behind the toilet 42 and the shower 40.

The water supply lines 30 include a hot water supply line and a cold water supply line, each having a flexible connection hose 90 at one end that attaches to the ship water supply lines 34. The water supply lines 30 are copper pipes shaped to route around the module 10. Each of the water supply lines 30 also has a manual control valve 92 that controls the flow of water through the supply line. The control valves 92 are attached to the supply lines 30 in the common area 88 adjacent to an aperture 94 formed in the wall 14 above the toilet 42. The aperture 94 is large enough to allow a person or user standing in the module 10 to easily reach through the aperture and access the control valves 92.

A removable access panel 96 covering the aperture 94 is mounted to the wall 13. Accordingly, the access panel 96 can be removed to gain access to the control valves 92 during, for example, installation or maintenance of the module. In the preferred embodiment, the access panel 96 is formed by a magazine rack that retains magazines and the like in a convenient location above the toilet 42, as shown in FIG. 2.

The plumbing system 32 also has a wall mounted drain line 36 that passes through the wall 14 at one end and attaches to the sink assembly 78 or other bathroom fixture. The drain line 36 also extends along the outside of the walls 14 and is secured to the walls with conventional brackets and fasteners. The drain line 36 terminates at a connection fitting 100 adjacent to the recessed portion 90 formed by the walls 14. The connection fitting 100 is a flexible connector that attaches to a drain tree 102 of the ship drain system 28.

In the preferred embodiment, the drain line 36 is a one-quarter inch PVC pipe shaped to route around the outside of the module. The drain line 36 can also be a fiberglass pipe, or other suitable pipe. The drain lines 36 must have a downward slope as it routes around the module to maintain proper drainage characteristics.

The module 10 is completely manufactured at a remote location, such as a factory, and transported to the shipyard for installation onto the deck of the ship during its construction. As best seen in FIG. 3, the module 10 can be arranged in the shower configuration with the shower 40 located in one corner of the module, the toilet 42 attached to a wall 14 adjacent to the shower, and the sink assembly 78 attached to a second wall such that a person has sufficient room to maneuver within the bathroom module. When the plumbing system 32 for this configuration requires maintenance or the like, the magazine rack/access panel 96 above the toilet is simply removed and a user can reach through the aperture 94 and, for example, adjust the control valves 92.

Figure 7:
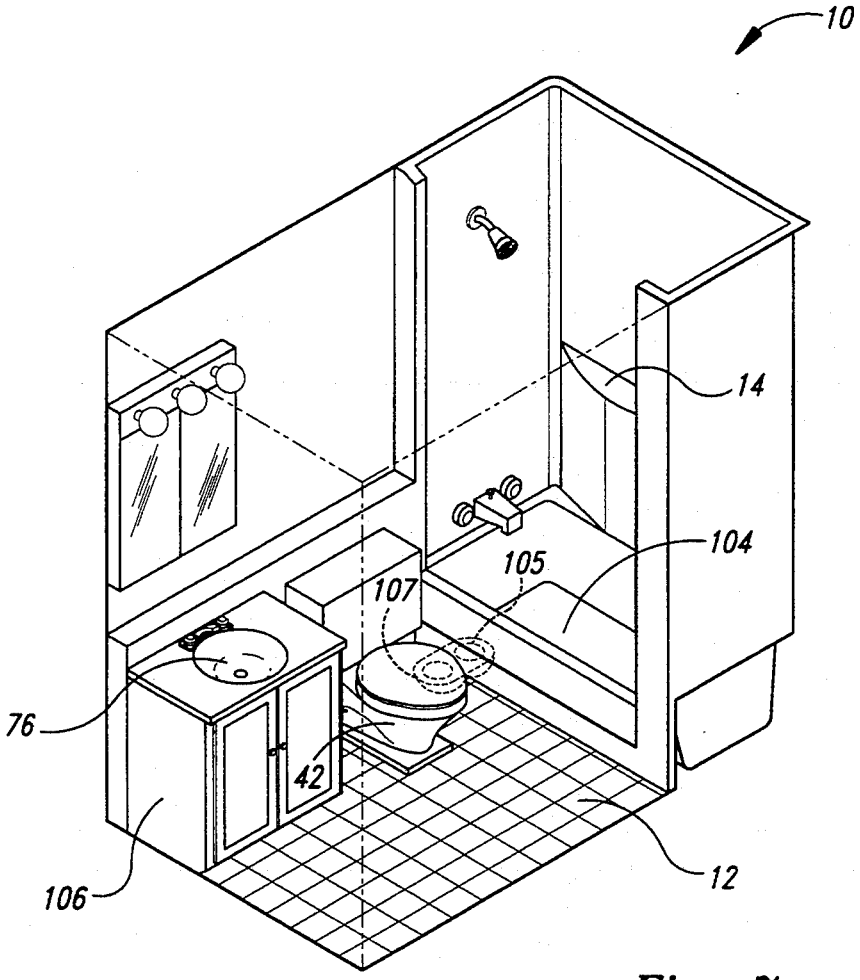
FIG. 7 is a top isometric view of an alternate arrangement of the bathroom module in accordance with the present invention having a bathtub therein, with two walls removed and a portion of the ceiling cutaway.

In an alternate configuration of the invention shown in FIG. 7, the bathroom module 10 has a bathtub and shower combination 104 integrally formed into the floor 12 and attached to the walls 14. A drain hole 105 coupled to the drain assembly 107 is provided in the bottom area of the bathtub. The toilet 42 is adjacent to the bathtub 104, a sink assembly 76 is next to the toilet, cabinetry 106 is attached to the sink assembly to provide storage within the module, and lights and minors mounted to the walls. Additional module configurations incorporating different bathroom fixtures can be created to accommodate specification of a ship being configured or built. The module 10 is also electrically wired at the factory and has a complete electrical system, including wiring, switches and outlets.

Numerous modifications and variations of the bathroom module for a marine vessel disclosed herein will occur to those skilled in the art in view of this disclosure. For example, two drain assemblies can be incorporated in different locations on the floor of the module to accommodate different configurations of the bathroom module. In addition, the access panel could be hidden behind a minor or other hinged component that would allow the access panel to be aesthetically pleasing while still maintaining easy accessibility to the plumbing system. Therefore, it is to be understood that these modifications and variations, and equivalents thereof, may be practiced while remaining within the spirit and scope of the invention as defined by the following claims.

We claim:

1. A prefabricated bathroom module for a marine vessel, the marine vessel having a plumbing system and deck that supports the module, the module comprising:

a floor positioned above the deck of the vessel, said floor having top and bottom surfaces with said bottom surface facing the deck, said floor being slanted relative to the deck toward a predetermined position, said floor having a first aperture therethrough at said predetermined position and a second aperture adjacent to said first aperture;

a plurality of walls attached to said floor and extending upward from said floor, said walls being interconnected to form and interior area defining a room, each of said walls having a top portion;

a ceiling attached to said top portions of said walls;

at least one bathroom fixture within said interior area; and, a drain assembly attached to said floor at said predetermined position, said drain assembly having a first drain pipe coaxially aligned with said first aperture, a first drain trap bowl attached to said bottom surface of said floor around said first aperture, and a drain line attached at one end to said first drain trap bowl and adapted to be attached at an opposite end to the plumbing system of the vessel, said first drain trap bowl being shaped to retain fluid therein at a predetermined fluid level, said first drain pipe extending downward from said floor into said first drain trap bowl and terminating at a position below said predetermined fluid level, said first drain trap bowl having an aperture therein with a bottom edge positioned at said predetermined fluid level, and said drain line is attached to said first drain trap bowl at said aperture so fluid within said first drain trap bowl above said fluid level will flow out of said first drain trap bowl through said drain line and into the plumbing system of said vessel, and said drain assembly having a second drain pipe coaxially aligned with said second aperture, a second drain trap bowl attached to said bottom surface of said floor adjacent to said second aperture, said second drain trap bowl being coupled to said first drain trap bowl and shaped to retain fluid therein at said predetermined fluid level, said second drain pipe extending downward from said floor into said second drain trap bowl and terminating at a position below said predetermined fluid level.

2. The bathroom module of claim 1 wherein said drain assembly is integrally connected to said floor.

3. The bathroom module of claim 1 wherein said second drain trap bowl is attached to said first drain trap bowl at said predetermined fluid level so fluid can pass between said first and second drain trap bowls when the fluid level rises above said predetermined fluid level.

4. The bathroom module of claim 1 wherein said drain assembly is integrally connected to said floor.

5. The bathroom module of claim 1, further comprising a bathtub area and said second aperture is in said bathtub area.

6. The bathroom module of claim 1, further comprising a shower area and said second aperture is located in said shower area.

7. The bathroom module of claim 6 wherein said shower area includes a shower dam to retain water in said shower area, said shower dam being positioned between said first and second apertures in said floor.

8. The bathroom module of claim 1, further comprising a plurality of supports attached to said floor and positioned to support said module on said deck so said floor is a predetermined distance above the deck and so a space is provided between said bottom surface of said floor and the deck with said drain assembly positioned within said space above the deck.

9. The bathroom module of claim 1 wherein said drain line slopes downward at a predetermined slope from said first drain trap bowl to the plumbing system of the vessel, said drain line attaching to the plumbing system at a position above the deck.

10. A prefabricated bathroom module for a marine vessel, the marine vessel having a water supply system, a drain system, and a deck that supports the bathroom module, the module comprising:

a floor positioned above the deck of the marine vessel, said floor having top and bottom surfaces with said bottom surface facing the deck, said floor having a first aperture therethrough at a predetermined position and having a second aperture adjacent to said first aperture;

a plurality of walls attached to said floor and extending upward from said top surface, said walls being interconnected to form an exterior of the module and an interior area defining a room, one of said walls further having an aperture formed therethrough, said aperture providing access to a predetermined outside area of said module;

an access panel removably mounted to said one wall and positioned in said aperture;

a ceiling attached to said walls;

at least one fixture mounted within said interior area;

a plumbing system attached to at least one of said walls along said exterior of said module, said plumbing system including at least one water supply line attached at one end to said fixture and attachable at a second end to the water supply system of the marine vessel, said water supply line having a control valve that controls flow of water therethrough, said control valve being located at said predetermined outside area adjacent to said access panel so a user within the room can access said control valve through said access panel; and, a drain assembly attached to said floor, said drain assembly having a first drain pipe coaxially aligned with said first aperture, a first drain trap bowl attached to said bottom surface of said floor around said first aperture, and a drain line attached at one end to said first drain trap bowl and adapted to be attached at an opposite end to the plumbing system of the vessel, said first drain trap bowl being shaped to retain fluid therein at a predetermined fluid level, said first drain pipe extending downward from said floor into said first drain trap bowl and terminating at a position below said predetermined fluid level, said first drain trap bowl having an aperture therein with a bottom edge positioned at said predetermined fluid level, and said drain line is attached to said first drain trap bowl at said aperture so fluid within said first drain trap bowl above said fluid level will flow out of said first drain trap bowl through said drain line and into the plumbing system of the vessel, and said drain assembly having a second drain pipe coaxially aligned with said second aperture, a second drain trap bowl attached to said bottom surface of said floor adjacent to said second aperture, said second drain trap bowl being coupled to said first drain trap bowl and shaped to retain fluid therein at said predetermined fluid level, said second drain pipe extending downward from said floor into said second drain trap bowl and terminating at a position below said predetermined fluid level.

11. The bathroom module of claim 10 wherein said access panel is a removable magazine rack.

12. The bathroom module of claim 10, wherein said plumbing system has a plurality of plumbing lines carried along said exterior of said module on at least one of said walls, said plumbing lines having control valves located at said predetermined outside area adjacent to said access panel.

13. The bathroom module of claim 10 having at least one drain line attached at one end to said fixture and attachable at an opposite end to the drain system of the marine vessel, said drain line being carded along said exterior of said module on at least one of said walls.

14. The bathroom module of claim 10 wherein said second drain trap bowl is attached to said first drain trap bowl at said predetermined fluid level so fluid can pass between said first and second drain trap bowls when the fluid level rises above said predetermined fluid level.

15. The bathroom module of claim 10 wherein said drain assembly is integrally connected to said floor.

16. A bathroom module for a marine vessel, the marine vessel having a plumbing system and deck that supports the module, the module comprising:

a floor supported by a plurality of supports above the deck of the vessel, said floor having first and second apertures therethrough;

a plurality of walls attached to said floor, said walls being interconnected to form an interior area of the module;

a ceiling attached to said walls;

at least one bathroom fixture within said interior area; and, a drain assembly attached to said floor, said drain assembly having a first drain pipe coaxially aligned with said first aperture in said floor, a first drain trap bowl attached to said floor adjacent to said first aperture, and a drain line attached to said first drain trap bowl, said first drain trap bowl being shaped to retain fluid therein at a predetermined fluid level, said first drain pipe extending into said first drain trap bowl and terminating at a position below said fluid level, said first drain trap bowl being attached to said drain line so fluid within said first drain trap bowl above said fluid level will flow out of said first drain trap bowl into said drain line, and said drain assembly having a second drain pipe coaxially aligned with said second aperture, a second drain trap bowl attached to said bottom surface of said floor adjacent to said second aperture, said second drain trap bowl being coupled to said first drain trap bowl and shaped to retain fluid therein at said predetermined fluid level, said second drain pipe extending downward from said floor into said second drain trap bowl and terminating at a position below said predetermined fluid level.

* * * * *

UNITED STATES PATENT AND TRADEMARK OFFICE

CERTIFICATE OF CORRECTION

PATENT NO. : 5,438,713
DATED : August 8, 1995
INVENTOR(S) : Richard E. Clarke

It is certified that error appears in the above-indentified patent and that said Letters Patent is hereby corrected as shown below:

In Column 8, line 7, please "delete "and" and substitute therefor --an--

In Column 8, line 67, please insert a ",".

In Column 9, line 1, after "said" and before "drain", please insert --first--.

Signed and Sealed this

Nineteenth Day of December, 1995

*Attest:*

*Attesting Officer*

BRUCE LEHMAN

*Commissioner of Patents and Trademarks*